US006454405B1

(12) United States Patent
Stowe

(10) Patent No.: US 6,454,405 B1
(45) Date of Patent: Sep. 24, 2002

(54) APPARATUS AND METHOD FOR CURING UV CURABLE INK, COATING OR ADHESIVE APPLIED WITH AN INK-JET APPLICATOR

(75) Inventor: Richard W. Stowe, Hillandale, MD (US)

(73) Assignee: Fusion UV Systems, Inc., Gaithersburg, MD (US)

( * ) Notice: Subject to any disclaimer, the term of this patent is extended or adjusted under 35 U.S.C. 154(b) by 92 days.

(21) Appl. No.: 09/615,052

(22) Filed: Jul. 12, 2000

(51) Int. Cl.[7] ..... B41J 2/01
(52) U.S. Cl. ..... 347/102
(58) Field of Search ..... 347/102

(56) References Cited

U.S. PATENT DOCUMENTS 4,303,924 A 12/1981 Young, Jr.
4,340,893 A * 7/1982 Ort ..... 347/102
4,978,969 A 12/1990 Chieng
5,212,526 A 5/1993 Domoto et al.
5,275,646 A 1/1994 Marshall et al.
5,623,001 A 4/1997 Figov
5,645,888 A 7/1997 Titterington et al.
5,713,673 A 2/1998 Nemoto et al.
5,738,916 A 4/1998 Noguchi et al.
5,777,639 A 7/1998 Kageyama et al.
5,847,732 A 12/1998 Shinozaki et al.
5,952,401 A 9/1999 Kimura et al.
5,958,169 A 9/1999 Titterington et al.
5,980,011 A 11/1999 Cummins et al.
6,145,979 A * 11/2000 Caiger et al. ..... 347/102

* cited by examiner

*Primary Examiner*—John Barlow
*Assistant Examiner*—Ly T Tran
(74) *Attorney, Agent, or Firm*—Shlesinger, Arkwright & Garvey LLP

(57) ABSTRACT

An ink-jet applicator comprises a print head including a housing; a guide operably secured to the housing to guide the housing across a medium being imprinted; a UV light source disposed at one end of the guide to generate a beam of radiation; and a mirror carried by the housing adapted to reflect the beam onto the UV curable coating deposited by the print head onto the work surface.

12 Claims, 1 Drawing Sheet

APPARATUS AND METHOD FOR CURING UV CURABLE INK, COATING OR ADHESIVE APPLIED WITH AN INK-JET APPLICATOR

FIELD OF THE INVENTION

The present invention is directed to an ink-jet applicator using UV curable ink, coating or adhesive and particularly to an ink-jet applicator having means for curing the UV curable ink, coating or adhesive just after it has been deposited onto a work surface.

BACKGROUND OF THE INVENTION

There are several types of print heads which are capable of producing a finely directed stream or droplet flow of ink to a surface which is moving relative to the print head. By applying digitized signals, which has been resolved and rasterized from an image, to the print head, a digital print is produced. Typically, in large-format digital printing, the print head is moving in one direction while the work surface or sheet is moved in a perpendicular direction. These two motions, in combination with an ink color and impulse signal sent to the print head, produce an image which builds, line-by-line, on the work surface. This method of plotting is well-established and commonly used.

UV curing of the ink is most effective when applied immediately or as soon as practical after the deposition of the ink. The UV radiance required to cure opaque inks is in the range of 1–20 watts/cm$^2$, and may be anywhere in the range of 200 nm through visible light wavelengths. This suggests mounting the exposure lamp on the print head mechanism, in order to follow the print closely. However, higher speed printing requires the total mass of the print head be as low as possible.

OBJECTS AND SUMMARY OF THE INVENTION

It is an object of the present invention to provide an ink-jet applicator using UV curable ink, coating or adhesive that provides curing of the liquid immediately after deposition on the work surface.

It is another object of the present invention to provide an ink-jet applicator for UV curable ink, coating or adhesive with the capability of the curing the liquid immediately after deposition while keeping the total mass of the print head relatively low.

In summary, the present invention provides an ink-jet applicator comprising a print head including a housing; a guide operably secured to the housing to guide the housing across a medium being imprinted; a UV light source disposed at one end of the guide to generate a beam of radiation; and a mirror carried by the housing adapted to reflect the beam onto the UV curable coating deposited by the print head onto the work surface.

The present invention also provides a method for curing UV curable coating applied with an ink-jet applicator, comprising providing a print head movable along a guide across a work surface to be imprinted; providing a UV light source at one end of said guide to generate a beam of radiation; and reflecting the beam onto the coating just deposited by the print head onto the work surface.

These and other objects of the present invention will become apparent from the following detailed description.

BRIEF DESCRIPTIONS OF THE DRAWINGS

DETAILED DESCRIPTION OF THE INVENTION

Figure 1:
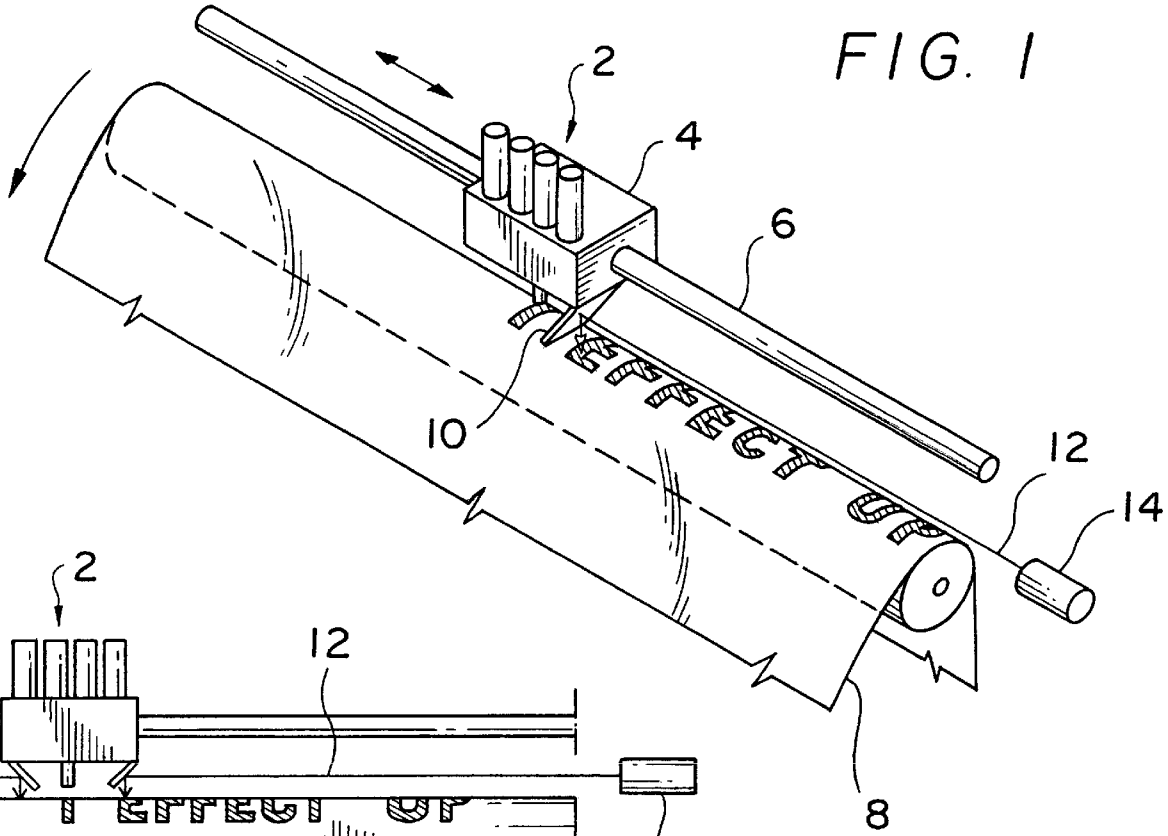
FIG. 1 is a perspective of a print head applicator made in accordance with the present invention.

Referring to FIG. 1, a digital print head 2 includes a housing 4 carried by a guide 6. The guide 6 may include a drive mechanism (not shown) that cooperates with the housing 4 to drive the print head 2 back and forth across the medium or work surface 8. A mirror 10 is carried by the housing 4 and is oriented to reflect a beam of UV light 12 generated by a UV light source 14. The mirror 10 focuses light onto the work surface 8 in a spot immediately following the print to at least illuminate the series of ink dots most recently applied by the print head. The mirror 10 is disposed at a distance in such a way that it will not interfere with the ink jet itself.

By focusing small, but intense beam of UV light parallel to and along the axis of travel of the print head, and by placing the small mirror 10 to redirect the light to the work surface, the mass required to be added to the print head can be extremely small. The light source may be high intensity but its size and weight do not affect the speed of travel or response at the print head. The focused light remains always in alignment of travel of the mirror, which is oriented at approximately 45° to the incident beam. The mirror may be flat or curved to redirect or concentrate the beam onto the work surface.

Figure 2:
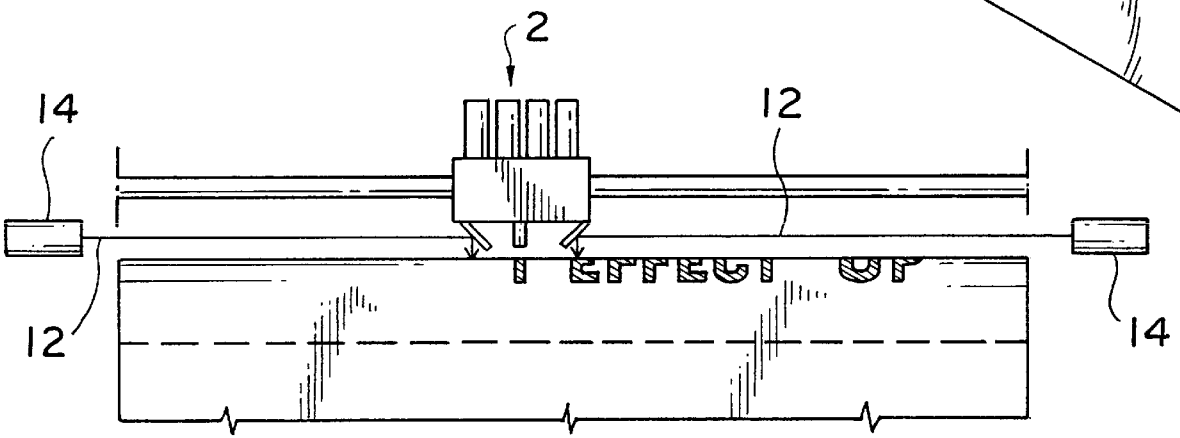
FIG. 2 is a front elevation view of FIG. 1.

Transport mechanisms for the print head are most often bi-directional. In this case, light source 14 may be located at both ends of the head travel in order to precisely illuminate the applied ink after the head has deposited the ink, and do this in both directions of travel, as best shown in FIG. 2.

The light source 14 can consist of a traditional light source with focusing and collimating optics, or may be a UV/bis laser. The illuminated area may overlap several passes, thereby providing additional radiant energy to areas previously cured, or partially cured.

The present invention reduces the total radiant energy required to accomplish the cure of the ink because light of high intensity is focused onto only a small area. Coverage relies on the multi-pass motion of the print head.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An ink-jet applicator, comprising:

a) a print head including a housing for applying a UV curable coating on a work surface;

b) a guide operably secured to said housing to guide said housing across the work surface being imprinted, a portion of the work surface being imprinted upon while the housing is guided defining an area;

c) an UV light source disposed at one end of said guide to generate a beam of radiation; and d) a mirror carried by said housing adapted to reflect the beam onto the UV curable coating in said area, while the print head is guided over said area.

2. An ink-jet applicator as in claim 1, wherein said mirror is oriented 45° relative to the work surface and the beam.

3. An ink-jet applicator as in claim 1, wherein said mirror is flat.

4. An ink-jet applicator as in claim 1, wherein said mirror is curved.

5. An ink-jet applicator as in claim 1, wherein said light source is a UV/bis laser.

6. An ink-jet applicator as in claim 1, and further comprising:

a) another UV light source disposed at an opposite end of said guide to generate another beam of radiation; and b) another mirror carried by said housing adapted to reflect the other beam onto the UV curable coating deposited by said print head onto the work surface.

7. A method for curing UV curable coating applied with an ink-jet applicator, comprising:

a) providing a print head including a housing movable along a guide across a work surface to be imprinted, a portion of the work surface being imprinted upon while the housing is guided defining an area;

b) providing a UV light source at one end of said guide to generate a beam of radiation; and c) reflecting the beam onto the UV curable coating in said area, while the print head is guided over the area.

8. A method as in claim 7, wherein said reflecting is provided by a mirror carried by said print head.

9. A method as in claim 8, wherein said mirror is oriented 45° relative to the work surface and the beam.

10. A method as in claim 7, wherein said reflecting is provided by a flat mirror.

11. A method as in claim 7, wherein said reflecting is provided by a curved mirror.

12. A method as in claim 7, and further comprising:

a) providing another UV light source disposed at an opposite end of said guide to generate another beam of radiation; and b) reflecting the other beam onto the coating just deposited by the print head onto the work surface.

* * * * *